United States Patent [19]

Gaisser

[11] Patent Number: 4,753,273

[45] Date of Patent: Jun. 28, 1988

[54] WEAVING SHAFT WITH SHAFT RODS OF ALUMINUM PROFILE

[75] Inventor: Rudi Gaisser, Reutlingen, Fed. Rep. of Germany

[73] Assignee: C.C. Egelhaaf GmbH & Co., Reutlingen, Fed. Rep. of Germany

[21] Appl. No.: 30,067

[22] Filed: Mar. 24, 1987

[30] Foreign Application Priority Data

Mar. 25, 1986 [DE] Fed. Rep. of Germany ..... 3609964

[51] Int. Cl.[4] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 3,335,759 | 8/1967 | Koch | 139/91 |
| 3,753,450 | 8/1973 | Koch | 139/91 |
| 3,949,789 | 4/1976 | Graf | 139/91 |

*Primary Examiner*—Henry S. Jaudon

*Attorney, Agent, or Firm*—Michael J. Striker

[57] ABSTRACT

A weaving shaft includes shaft rods and side supports connected to the rods. The rods are made of hollow aluminum profile and each is formed with a recess receiving a lateral projection formed on each side support. The thickness of the lateral projection corresponds to the thickness of the shaft rod. Anchoring bolts secure each side support at its projection via a plate applied to the shaft rod from the outer side thereof .

3 Claims, 4 Drawing Sheets

WEAVING SHAFT WITH SHAFT RODS OF ALUMINUM PROFILE

BACKGROUND OF THE INVENTION

The present invention relates to a weaving shaft, the rods of which are made of aluminum profile.

Weaving shafts of the type under discussion normally include two shaft rods of aluminum profile and side supports, whereby the side supports are supported at the ends of the shaft rods and each have a projection engaged in a hollow space of the aluminum profile and anchored there by means of bolts.

In operation of the weaving machine of this type, for enhancing productivity of such machines at high operation speeds, a problem has occured, which resides in that stability of the weaving shafts of conventional design has not been sufficient in order to take high swinging loads and quick motion changes. This has occured, particularly with the weaving shafts having shaft rods made of aluminum profile. It has been also known that the connection of the side supports to the hollow shaft rods should be provided with a projection which is insertable into the hollow profile by means of clamping jaws and the projection should be clamped by the bolts and held in a form-locking fashion. Such a connection, however has not been sufficient because only weak anchoring bolts could be utilized and the form-locking connection of the side supports with the ends of the shaft rods was too weak to withstand high loads.

SUMMARY OF THE INVENTION

It is an object of the present invention to provide an improved weaving shaft with the shaft rods of aluminum profile.

It is another object of this invention to provide a reliable connection of the side supports of the weaving shaft with its rods and ensure a good force transmission of the shaft drive to the shaft rods and side supports of the weaving shaft.

These and other objects of the invention are attained by a weaving shaft comprising shaft rods formed of aluminum hollow profile having hollow spaces therein; and side supports which are anchored at opposite ends of said shaft rods, each side support having projections each projecting into a hollow space of the aluminum profile of a respective shaft rod and anchored in said shaft rod by means of anchoring bolts, each projection having at least in the region of said anchoring bolts a thickness equal to a thickness of each shaft rod, each rod having recesses into which said projections extend, respectively, each rod having a narrow side provided with a plate applied thereto from outside, each anchoring bolt having a head lying against a respective plate, each rod having further plates inserted in a hollow space thereof and provided with threaded bores into which ends of said anchoring bolts are screwed, respectively.

The projections may be formed such that they abut against edges of respective recesses to which they match over the entire periphery thereof.

In the weaving shaft according to the present invention, the projections for connecting the side supports with the shaft rods are thicker than those of conventional weaving shafts so that the formation of greater through bores for stronger anchoring bolts is possible. The projections no longer lie only on the side walls of the hollow profile of the shaft rod and connection flanges as with conventional structures but they are supported in the recesses of the shaft rods without any cutting in. The narrow side of each shaft rod ensures due to the plate applied thereto a good distribution of forces transmitted by anchoring bolts.

In accordance with a further modification, each of said plates applied to the respective shaft rod from outside may be formed by a shaft drive piece, one of said bolts, simultaneously serving to secure said shaft drive piece to a respective shaft rod. With this modification, a distribution of loads or forces, on the side support takes place directly via the shaft drive piece.

A canting-resistant seat of each projection in a respective shaft rod is further enhanced if each of said projections has an extension which has a thickness smaller than that of said shaft rod and which passes into a hollow space of the aluminum profile of the respective shaft rod. Additional force-taking surfaces are provided on the inner walls of each shaft rod by those extensions.

The novel features which are considered as characteristic for the invention are set forth in particular in the appended claims. The invention itself, however, both as to its constructions and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
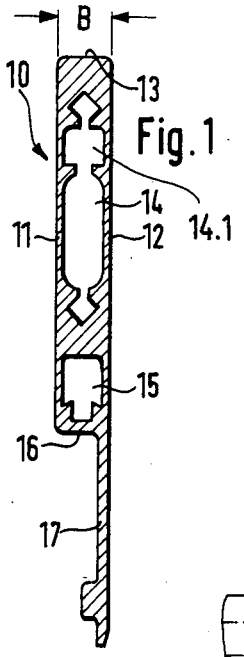
FIG. 1 is a sectional side view taken on line I—I of FIG. 3, of profiled aluminum shaft rod of the weaving shaft according to the invention.
Figure 2:
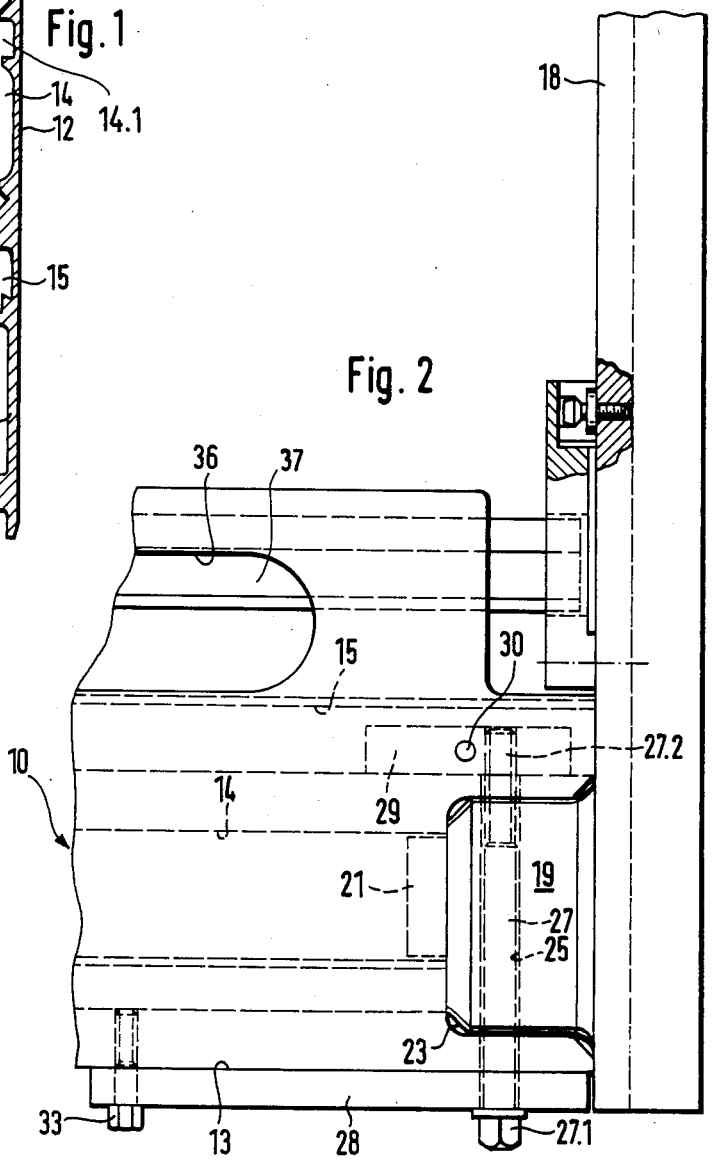
FIG. 2 is a front view of the right-hand lower corner of the rectangular weaving shaft, with the connection part of the side support with the end of the shaft rod.
Figure 3:
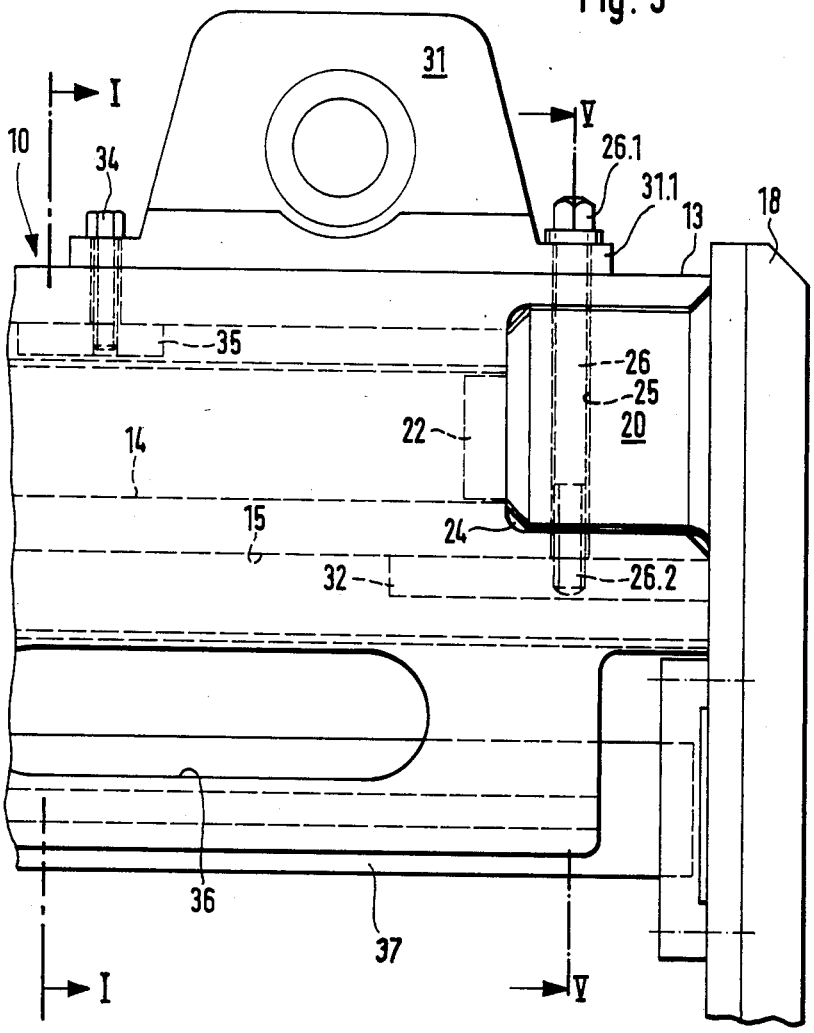
FIG. 3 is a front view of the right-hand upper corner of the weaving shaft of FIG. 2.

Referring now to the drawings in detail, FIG. 1 illustrates a shaft rod 10 of a weaving shaft, which rod is formed of aluminum-cord-pressed profile. The shaft rod 10 has closed side walls 13 and two recesses 14 and 15 in its interior. The maximal width of the profiled shaft rod 10 is designated by B One side wall 12 is extended over a lower narrow side 16 to form a supporting or holding portion 17 which can have, as shown in FIGS. 2 and 3, large recesses 36.

With the rectangular weaving shafts, both shaft rods 10 form in the known fashion, the upper and lower frame legs of the weaving shafts and are connected to each other by profiled but narrow side supports 18. FIG. 2 shows the right-side lower corner of the weaving shaft while FIG. 3 shows the right-side upper corner of the weaving shaft wherein the side support 18 is connected with one shaft rod 10. Middle support rods are designated with reference numeral 37.

Figure 6:
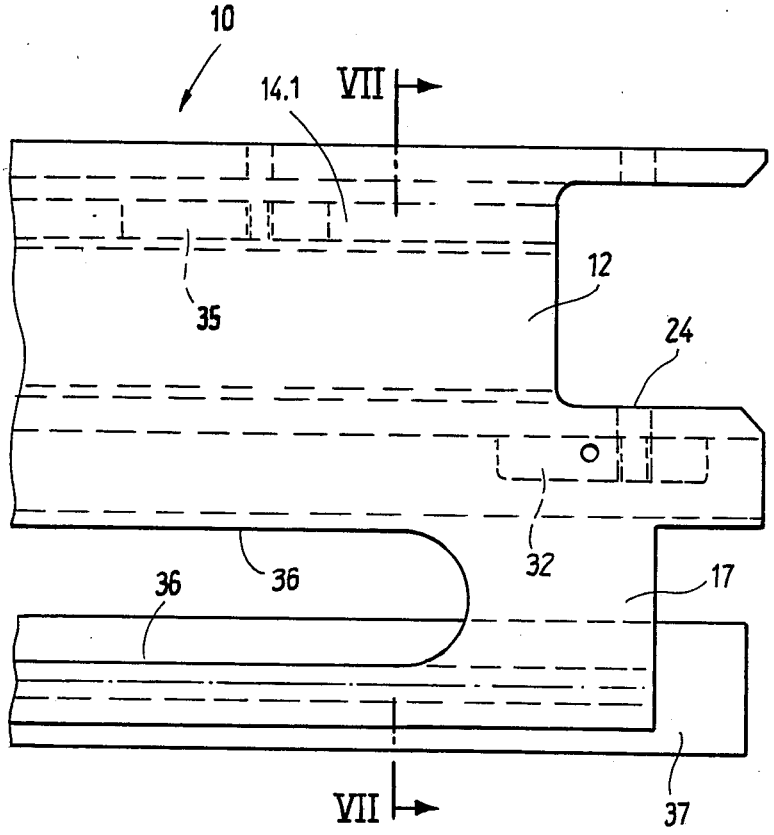
FIG. 6 is similar to FIG. 4 but showing only the end portion of the shaft rod.
Figure 7:
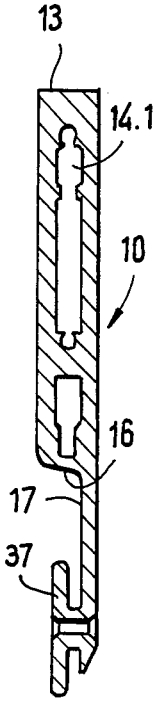
FIG. 7 is a sectional view taken on line VII—VII of FIG. 6.

The side support 18 is provided at two ends thereof with massive web-like lateral projections 19 and 20 each of which has the same thickness B as the shaft rod 10. Both projections 19 and 20 also have extensions 21, 22, respectively. The thickness of each extension 21, 22 is smaller than that of projections 19, 20 and corresponds to the width of the recess 14 of the shaft rod 10. Shown in FIG. 1 In order to receive respective projections 19 and 20 both, the lower and the upper shaft rods 10 of the weaving shaft are each provided with a front-side recess 23, 24. The shape of each recess 23, 24 exactly matches the shape of projections 19, 20 so that projections 19,20 can be, without canting, inserted into recesses 23, 24 formed for example by milling while the extensions 21 and 22 of the projection 19, 20 respectively, are inserted into the closed recess 14 of the respective shaft rod 10 as shown in FIGS. 2 and 3. One of those recesses namely recess 24 is shown in FIG. 6. The projections 19 and 20, one of which is also partially shown in FIG. 4*a*, are also supported over their entire peripheries at the recesses 23 and 24 and thus supported on the side walls 11 and 12 of each shaft rod 10.

Figure 4:
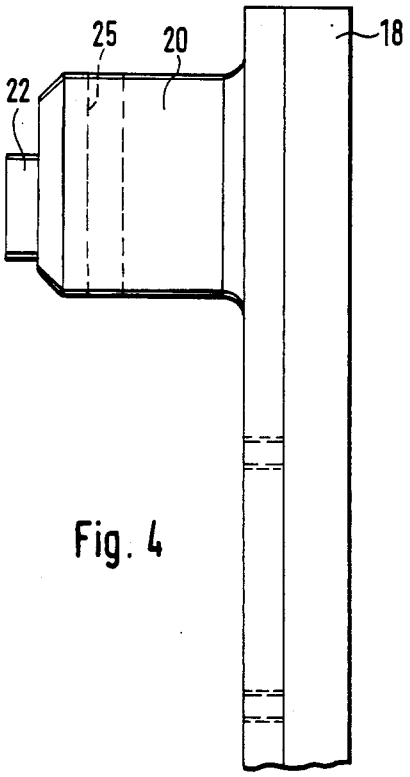
FIG. 4 is a view of the end region of the side support shown in FIG. 3.
Figure 4A:
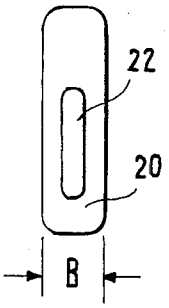
FIG. 4*a* is a partial front view of the projection of the side support.

As illustrated in FIG. 4, the projection 20 (also shown in FIG. 4*d*), and, of course, similarly the projection 19 of the side support 18 is provided with a through bore 25. The latter serves for receiving and passing therethrough an anchoring bolt 26 or 27. Bolts 26 and 27 are similar in structure as shown in FIGS. 2 and 3. The head 27.1 of bolt 27, as shown in FIG. 2, lies against an elongated plate 28 positioned on the narrow top side 13 of the shaft rod 10. Plate 28 also has a through bore, not shown, for receiving the anchoring bolt 27. The other end 27.2 of bolt 27, provided with the thread is screwed in a threaded bore of the second plate 29 (FIG. 2) which is inserted in the recess 15 of the shaft rod 10 and is held there by means of a clamping pin 30 which extends through a transverse bore provided in plate 29 and also the bores formed in side walls 11, 12 and aligned with that transverse bore.

With reference to FIG. 3 it will be seen that the upper connection of the side support 18 with the shaft rod 10 serves, at the same time, for the connection of a shaft drive element 31 placed on the top side 13 of the shaft rod 10 with the latter. A shaft drive device which is of any suitable known type and therefore not described herein is engaged on the element 31. A portion 31.1 of the shaft drive element 31 here forms a flange against which the end 26.2 of the bolt 26, provided with the thread, is screwed in the threaded bore of the plate 32 inserted in the recess 15 of the second shaft rod 10 and connected to this rod similarly to the connection of plate 29 as shwon in FIG. 6. While the plate 28 shown in FIG. 2 is additionally secured by means of a second bolt 33, which is anchored directly in the threaded bore of the shaft rod 10, the shaft drive element 31 shown in FIG. 3 is additionally secured by means of a bolt 34 which is anchored in an additional plate 35 inserted in the recess 14.1 of the shaft rod.

Figure 5:
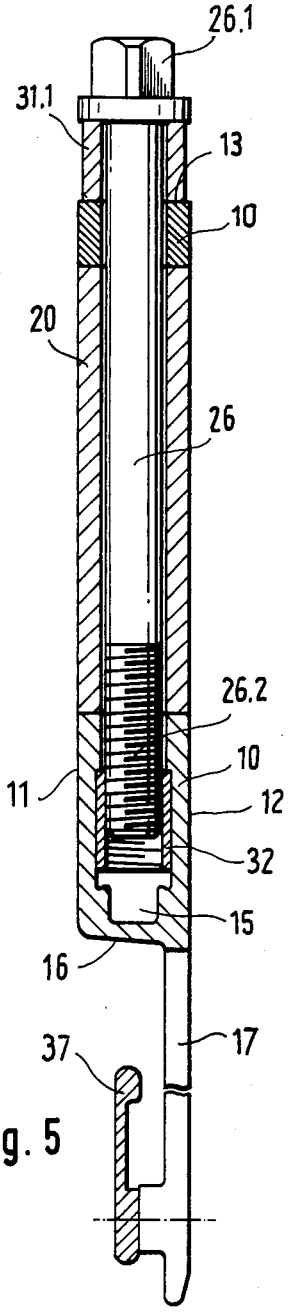
FIG. 5 is a sectional view through the connection of the side support with the shaft rod, taken along line V—V of FIG. 3 but on a double scale.

Plate 35 the shape of which matches that of recess 14.1 is also shown with dotted lines in FIG. 6. The connection of the side support 18 with the shaft rod 2 is shown in detail in the sectional view of FIG. 5. As shown bolt 26 is received in the bores of flange 31.1, shaft rod 10, projection 20 of side support 20 and plate 32 inserted in the recess 15 of the shaft rod 10.

By the removal of the relatively strong anchoring bolts 26 and 27 the side supports 18 can easily and quickly be released from the shaft rods 10. The plates 29 and 32 with the threaded bores, which serve to anchor the clamping bolts 26 and 27 respectively, are made expediently of steel. The anchoring of the bolts in a relatively soft aluminum material of the shaft rods 10 is also avoided. The plates can be easily interchanged when the threads in their bores are damaged.

It will be understood that each of the elements described above, or two or more together, may also find a useful application in other types of weaving shafts differing from the types described above.

While the invention has been illustrated and described as embodied in a weaving shaft, it is not intended to be limited to the details shown, since various modifications and structural changes may be made without departing in any way from the spirit of the present invention.

Without further analysis, the foreging will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A weaving shaft comprising shaft rods formed of aluminum hollow profile provided with hollow spaces; and side supports which are anchored at opposite ends of said shaft rods, each side support having projections each projecting into a hollow space of the aluminum profile of a respective shaft rod and anchored in said shaft rod by means of anchoring bolts, each projection (19, 20) having at least in the region of said anchoring bolts (26, 27) a thickness equal to a thickness of each shaft rod (10), each rod having side walls formed with recesses (23, 24) into which said projections extend respectively, each rod having a narrow side provided with a plate (28, 31.1) applied thereto from outside, each anchoring bolt having a head lying against a respective plate, each rod having further plates (29, 32) positioned in a further one of said hollow spaces (15) and provided with threaded bores into which ends (26.2, 27.2) of said anchoring bolts are screwed, each of said projections having an extension which has a thickness smaller than that of said shaft rod and which passes into one of the hollow spaces (24) of the aluminum profile of the respective shaft rod.

2. The weaving shaft as defined in claim 1, wherein said projections (19, 20) are formed such that they abut against said side walls at said recesses (23, 24) to which they match in shape.

3. The weaving shaft as defined in claim 1, wherein one of said plates applied to the respective shaft rod from outside is a shaft drive element (31), one of said bolts (26) simultaneously serving to secure said shaft drive element to a respective shaft rod.

* * * * *